United States Patent [19]

Johnson

[11] 4,437,421

[45] Mar. 20, 1984

[54] VARIABLE PULL OFF FOR BOBBIN THREAD

[75] Inventor: Ralph E. Johnson, Convent Station, N.J.

[73] Assignee: The Singer Company, Stamford, Conn.

[21] Appl. No.: 414,556

[22] Filed: Sep. 3, 1982

Related U.S. Application Data

[63] Continuation of Ser. No. 204,426, Nov. 6, 1980, abandoned.

[51] Int. Cl.[3] ..... D05B 3/02; D05B 27/22; D05B 27

[52] U.S. Cl. ..... 112/158 R; 112/184; 112/242

[58] Field of Search ..... 112/158 R, 181, 184, 112/242, 243, 323

[56] References Cited

U.S. PATENT DOCUMENTS

| | | | |
|---|---|---|---|
| 1,105,968 | 8/1914 | Diehl et al. | 112/242 |
| 3,164,113 | 1/1965 | Ketterer | 112/242 |
| 3,467,039 | 9/1969 | Greenwood, Jr. et al. | 112/242 X |
| 3,693,565 | 9/1972 | Ketterer | 112/184 |
| 4,091,753 | 5/1978 | Johnson et al. | 112/184 |

*Primary Examiner*—Wm. Carter Reynolds
*Attorney, Agent, or Firm*—Robert E. Smith; Edward L. Bell

[57] ABSTRACT

A variable under thread pull off device in a sewing machine for providing the proper amount of slack in the bobbin thread to effect uniform stitch formation. The device will pull off a varying amount of bobbin thread to correspond to that which is required for each particular bight position of the stitch being set.

5 Claims, 6 Drawing Figures

Fig. 4
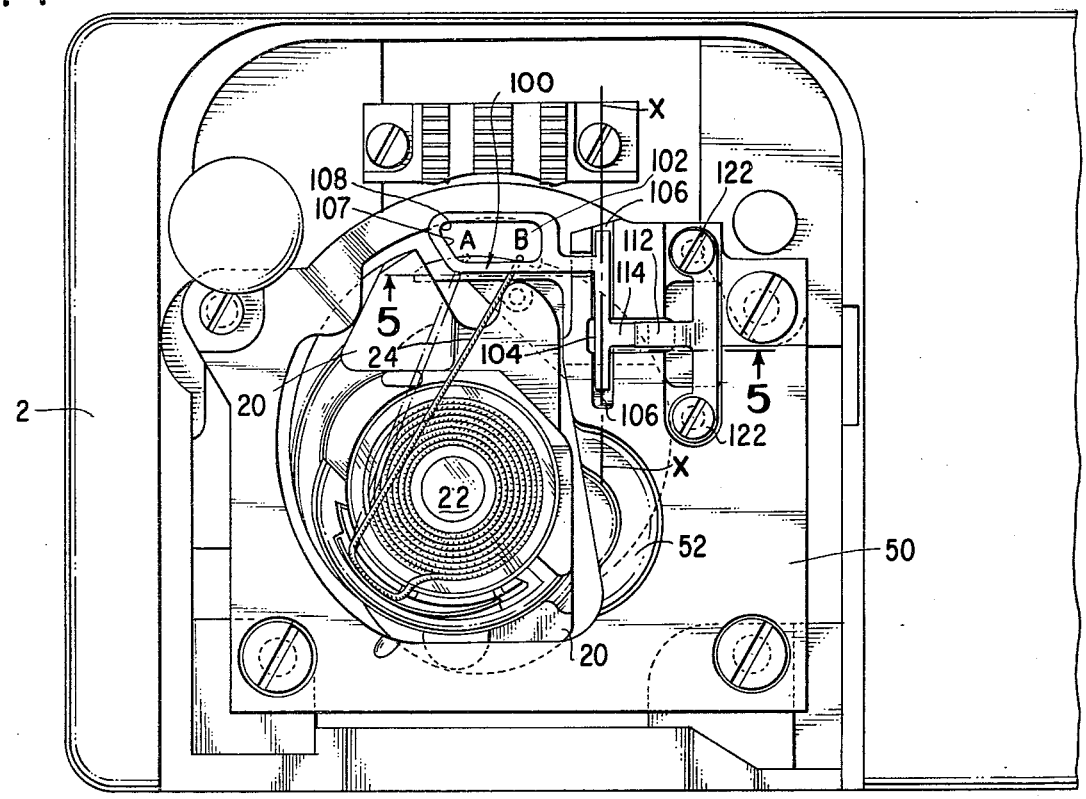
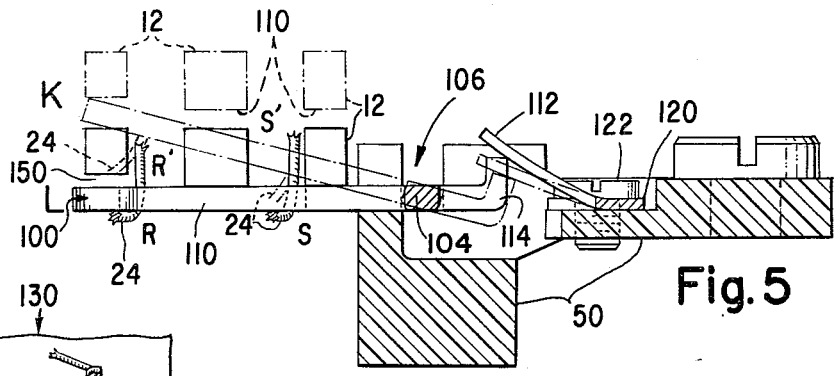
Fig. 5
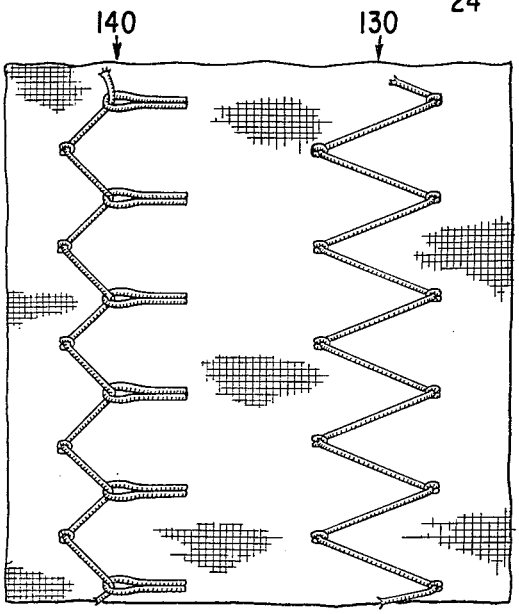
Fig. 6

VARIABLE PULL OFF FOR BOBBIN THREAD

This application is a continuation of application ser. no. 204,426, filed Nov. 6, 1980, now abandoned.

DESCRIPTION

Background of the Invention

This invention relates to thread handling devices for use in a sewing machine, and more particularly to a thread pull off mechanism for providing slack in the bobbin thread of a lock stitch sewing machine.

When sewing zig zag stitches with a sewing machine having a bobbin thread tensioning device which is located to one side of the bobbin, the needle will penetrate the work piece closer to the thread tensioning device when in one extreme bight position than in the opposite extreme bight position. Therefore, the thread limb length varies. As a result, less slack is required in the bobbin thread when setting a stitch in the one needle position than in the other.

It is known to provide thread pull off devices in lock stitch sewing machines that supply a constant amount of slack bobbin thread for each stitch regardless of the type of stitch being formed. This, however, can cause one stitch, in a zig zag pattern to be drawn too tight while the other stitch is too loose. Cording of the material or non-uniform stitch formation frequently result. Devices which provide constant thread pull off are disclosed in U.S. Pat. No. 3,693,565, Sept. 26, 1972, Ketterer and U.S. Pat. No. 4,091,753, May 30, 1978, Johnson et al, the teachings of which are incorporated herein by reference.

It is also known to provide thread pull off devices in lock stitch sewing machines that supply a variable amount of slack bobbin thread to correspond to the requirements of each individual stitch. See, for example, U.S. Pat. No. 4,215,639, Aug. 5, 1980, Johnson, the teachings of which are incorporated herein by reference. The Johnson mechanism, however, is a relatively complex structure requiring a separate actuator, such as a servo motor, and associated circuitry to adjust the amount of thread pull off that will occur.

The present invention overcomes these disadvantages through the use of a novel but simple mechanism.

SUMMARY OF THE INVENTION

It is an object of this invention to provide a variable thread pull off mechanism to provide the proper amount of slack in the bobbin thread to effect uniform stitch formation.

It is another object of this invention to inhibit the formation of half hitches.

It is another object of this invention to provide a variable thread pull off mechanism of simple construction wherein the amount of thread pull off is effected without the use of a separate actuator.

It is another object of this invention to provide a variable thread pull off mechanism wherein the proper amount of thread pull off occurs automatically as a result of the bight position of the needle when penetrating the work piece.

Other objects and advantages of the invention will become apparent through reference to the accompanying drawings and descriptive matter which illustrate a preferred embodiment of the invention.

According to the present invention, there is provided an arrangement for pulling thread from a bobbin in a lock stitch sewing machine for effecting a predetermined amount of slack in the bobbin thread in accordance with the requirements of each individual stitch. The arrangement includes a movable bobbin thread pull off member having a thread engaging surface transverse to the thread path. Means is provided for effecting movement of the bobbin thread pull off member in a fixed path, cyclically and in timed relation with the stitch forming instrumentalities of the sewing machine. The movement in a fixed path has a component transverse to the thread path.

BRIEF DESCRIPTION OF THE DRAWINGS

In order that the invention be more fully understood, it will be described by way of example with reference to the accompanying drawings in which:

FIG. 4 is a plan view of the area of the sewing machine shown in FIG. 1;

FIG. 5 is a partial section taken along the lines 5—5 of FIG. 4; and FIG. 6 is a schematic representation of a work piece showing two zig zag stitch patterns.

DESCRIPTION OF THE PREFERRED EMBODIMENT

Figure 1:
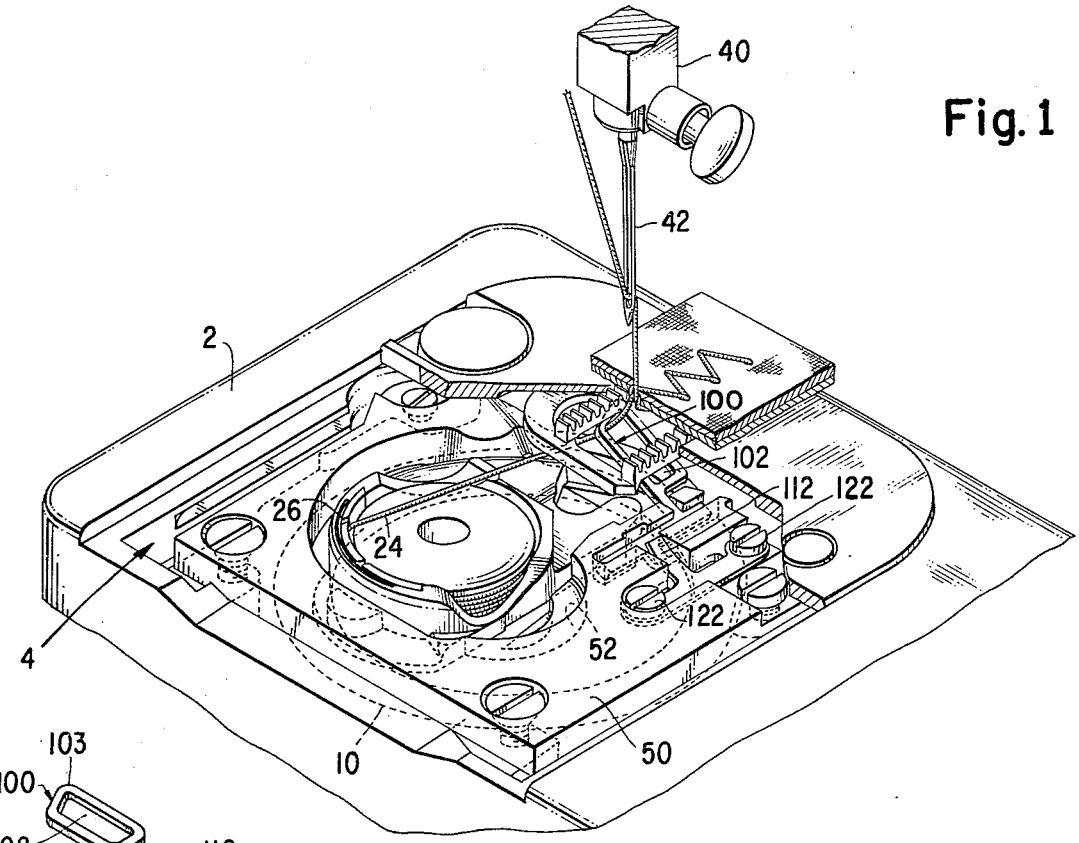
FIGS. 1 and 2 are perspective views of a portion of the sewing machine in the area of the loop taker, showing a preferred embodiment of the invention.

Referring to FIGS. 1, 2, 4 and 5, there is shown a portion of a sewing machine bed 2 having an upwardly open compartment 4 for housing a rotating hook 10 or looptaker and a work feed dog 12. The hook has an open ended hollow cavity 14 and a flat upper surface 16. Suspended within the cavity 14 is a bobbin case 20 having a thread carrying bobbin 22 positioned therein, said bobbin 22 having bobbin thread 24 wound thereon. The bobbin case 20 has a lower flanged surface 30 which lightly rests on the surface 16 of the hook 10 for partial support of the bobbin case 20. An endwise reciprocating needle bar 40 is carried in a sewing machine head, not shown, for imparting vibratory motion to a thread carrying needle 42 in cooperation with the hook 10 in the formation of lockstitches. A bobbin case retaining and positioning bracket 50 is rigidly mounted to the bed 2 and has an opening 52 for loosely engaging the bobbin case 20. The bracket positions the bobbin case with respect to the hook 10 yet allows the needle thread to be cast about the case 20 without significant interference from the bracket 50. The structure described above is well known in the art. See for example, U.S. Pat. No. 3,373,707, Mar. 19, 1968, Ketterer, which discloses similar structure in more detail, the teachings of which are incorporated herein by reference.

Figure 3:
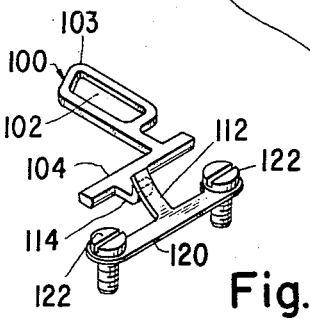
FIG. 3 is a perspective view of the thread pull off bar and spring.

As best seen in FIGS. 3, 4 and 5, a thread pull off member 100 of substantially rectangular shape and having a central perforation 102, has attached to one extremity a pivotal support member 104 formed orthogonal thereto and having a pivotal axis normal to the thread pull off member 100. The member 104 fits loosely into and engages the lower surface of a slot 106 formed in the bracket 50, as can be seen in FIGS. 4 and 5. The free extremity 103 of the thread pull off member 100 extends under the feed dog 12 and is biased into engagement with the undersurface 110 thereof by the action of a leaf spring 112 acting downwardly on a tab 114. The tab 114 is formed outwardly from the pivotal axis of the member 104 in a direction opposite that of the thread pull off member 100. The leaf spring 112 has a base portion 120 which is mounted to the bracket 50 by suitable fasteners 122. As the feed dog 12 rises and falls, so does the thread pull off member 100. During the downward motion the surface 110 of the feed dog urges the thread pull off member 100 downward. As the feed dog rises, the spring 112 urges the tab 114 downward, thereby pivoting the support member 104 and causing the thread pull off member 100 to follow the rise of the feed dog and remain in engagement with the surface 110. The central perforation 102, in the vicinity of the free extremity 103, has a surface 107 which is inclined with respect to the pivotal support member 104. The surface 107, beginning at A, as seen in FIG. 4, recedes from the member 104 and the bobbin 22 and terminates at a point 108.

Figure 2:
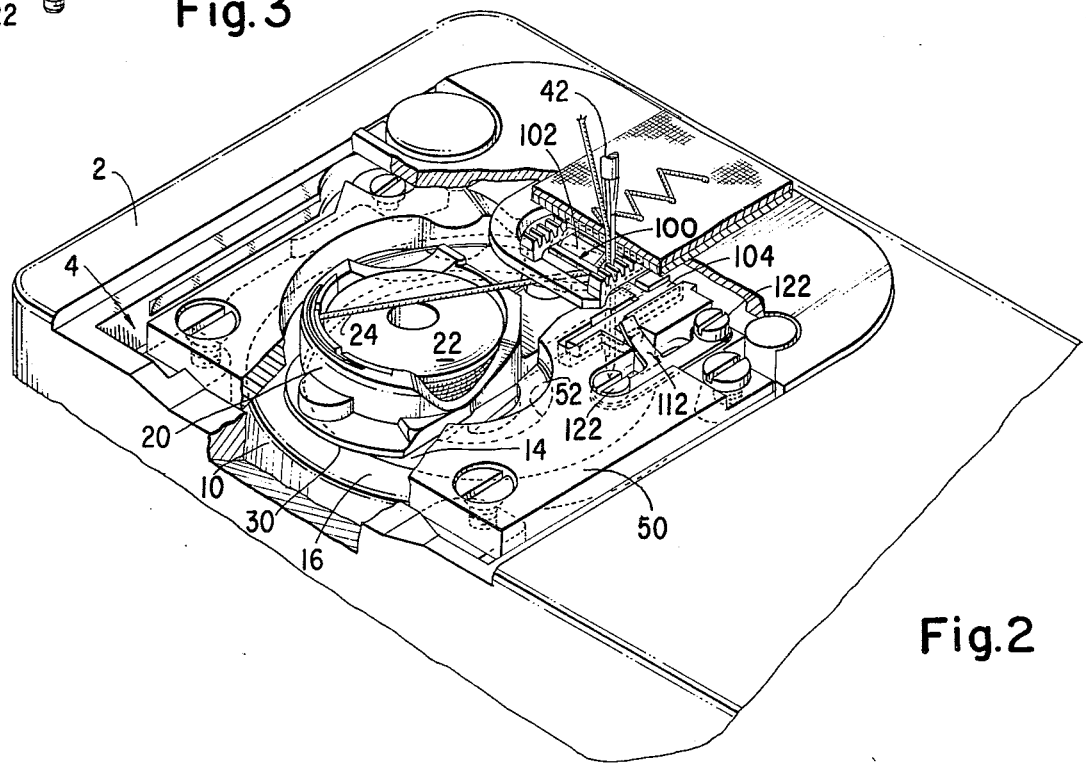

In operation, the bobbin thread 24 follows a path from the thread tensioning device 26 of the bobbin case 20, which is arranged beyond the left hand side of the line of zig zag stitch formation as shown in FIGS. 1 and 2 diagonally over the top of the bobbin 22, under the forward thread engaging edge of the thread pull off member 100, and up through the perforation 102 to the work piece being sewn. As shown in FIGS. 1, 2 and 4, the pivotal support 104 for the thread pull off member 100 is arranged on a axis X-X substantially perpendicular to the direction of needle jogging movement and beyond the right hand side of the line of zig zag stitch formation which is the opposite side thereof from the bobbin thread guide means 26. Referring to FIG. 1, the needle is shown in the up position just after the stitch is set in the leftmost bight position of a zig zag pattern. Note that the bobbin thread 24 is positioned within the perforation 102 and in engagement with an outer thread engaging portion of the pull off member 100 as shown at A in FIG. 4. The feed dog 12 is in its full up position and the thread pull off member 100 is pivoted upward so that its free extremity 103 is raised to its highest point as shown in FIG. 5 at K. There is a small recess 150 in the underside of the leftmost foot of the feed dog 12 which allows the thread pull off member 100 to pivot upwardly a maximum amount. As the needle swings to the rightmost bight position of the zig zag pattern and begins to pierce the work as shown at B in FIG. 4, the feed dog 12 is lowered by the feed dog drive mechanism, not shown, and thereby urges the thread pull off member 100 to pivot about the member 104 until it assumes the position L in FIG. 5. An the extremity 103 moves from position K to position L, it forces the thread 24 downward whereby a predetermined amount of thread is pulled from the bobbin 22 and throygh the thread tensioning device 26 creating a slack in the thread 24 between the tensioning device 26 and the last stitch that had been set in the work piece. With the needle 42 in the rightmost bight position, as shown in FIG. 2, the work limb of the needle thread, not shown, moves along the inclined surface 107 to the point 108. This assured that the loop of needle thread is sufficiently expanded as the looptaker begins to cast it about the bobbin case 20. The needle 42 and feed dog 12 then rise permitting the thread pull off member 100 to rise, thereby making the slack in the bobbin thread 24 available for setting the stitch. As the needle 24 moves to the leftmost bight position, the bobbin thread 24, as seen in FIG. 5, will remain substantially in the position indicated by S' and as shown at B in FIG. 4 will remain in engagement with an inner thread engaging portion of the pull off member 100. When the feed dog 12 begins to lower, it forces the thread pull off member 100 downwardly until it reaches the position indicated at L in FIG. 5. This downward motion of the thread pull off member 100 again forces the thread 24 downward whereby a predetermined amount of thread is pulled from the bobbin 22 and through the thread tensioning device 26 creating slack as before. However, this time less slack is created because, as the thread 24 moves form S' to S, in FIG. 5, it moves a shorter distance than when it moves from R' to R as before. Since the leftmost bight position of the needle 42 is closer to the thread tensioning device 26, where the bobbin thread exits, than is the right most bight position, less slack is required in the bobbin thread 24 when a stitch is being set in the leftmost position than when the stitch is being set in the right most position. Stated in other words, the variation in length of thread path from the thread tension device 26 which guides the thread from the bobbin to the point of needle penetration in left or right zagged positions varies inversely with the amount of bobbin thread pulled off after such needle penetration; and moreover, the difference in the amount of bobbin thread pulled from the bobbin after needle penetrations at opposite extreme laterally jogged positions of the needle is substantially equal to the difference in length of said bobbin thread paths between needle penetrations at opposite extreme laterally jogged positions. This requirement is met by the variable pull off action of the thread pull off member 100 as described above. A predictable amount of bobbin thread is pulled from the bobbin and is directly proportional to the bight position of needle penetration of the work piece. This results in a uniform appearing zig zag stitch pattern as shown in the right pattern 130 of FIG. 6. The left pattern 140 of FIG. 6 illustrates the stitch that could result if insufficient slack were provided in the bobbin thread 24 prior to setting the stitch in the rightmost bight position.

The operation of the invention is described above in terms of the needle occupying a left most bight position and a rightmost bight position, however, the device as disclosed herein will provide the proper amount of slack for any bight position that is within the operating range of the sewing machine. A most important feature of this invention is that the thread pull off member 100 will pull off a varying amount of slack bobbin thread 24 to correspond to that which is required for each particular bight position of the stitch being set. This result is achieved through the combination of a substantially straight thread engaging surface that has pivotal motion imparted thereto. Other combinations of shapes of the thread engaging surface and relative motions imparted thereto can produce a similar result. For example, a straight thread engaging surface that is inclined with respect to the bed of the sewing machine and having a linear motion imparted thereto in the vertical direction will provide the desired result. The important requirement is that the configuration of the thread engaging surface in combination with a predetermined motion thereof must result in a predictable amount of thread pull off corresponding to each different laterally jogged position of needle penetration.

Another important feature of this invention is the minimizing of half hitching when the sewing machine is sewing in straight stitch mode with the needle 42 located in the leftmost position. Just prior to each needle penetration, the bobbin thread 24 will be urged by the thread pull off member 100 into the position indicated at A in FIG. 4. This assures that the needle will always pass to the right of the bobbin thread and thus prevent half hitching.

Upon reviewing the present disclosure, a number of alternative constructions will occur to one skilled in the art. Such constructions may utilize thread pull off members of various shapes with or without perforations and having pivotal, arcuate, or linear movement. Such alternative constructions are considered to be within the spirit and scope of this disclosure.

I claim:

1. In a sewing machine having a bed and stitch forming instrumentalities including a thread carrying needle, said needle having an endwise reciprocating motion imparted thereto so that said needle will penetrate a work piece supported by said bed, a feed dog for effecting movement of the work piece in cooperation with said needle, said needle being capable of having a jogging motion imparted thereto which is lateral to the direction of said movement of the work piece to produce zig zag stitches, a loop taker adapted to operate in cooperation with said needle in the formation of lockstitches and having a bobbin accommodating cavity, a thread carrying bobbin disposed in said cavity, a bobbin thread tensioning device associated with said bobbin for tensioning bobbin thread as it is pulled from said thread carrying bobbin, said bobbin thread following thread paths of varying length between said thread tensioning device and the different laterally jogged positions of said needle penetration; an arrangement for pulling thread from said thread carrying bobbin to effect uniform zig zag stitches comprising: (a.)

a movable bobbin thread pull-off member having a thread engaging surface transverse to said thread paths, said thread engaging surface having different portions arranged for engagement with said bobbin thread in each of the different laterally jogged positions of needle reciprocation; (b.)

means for effecting movement of said bobbin thread pull-off member in a fixed path cyclically and in timed relation with said stitch forming instrumentalities, and with said different portions of the thread engaging surface each partaking of an extent of movement different from other portions while in engagement with said bobbin thread; (c.)

whereby said bobbin thread pull-off member is effective to pull from said bobbin an amount of bobbin thread subsequent to each different laterally jogged position of said needle penetration which amount of bobbin thread pull-off is substantially proportional to the extent of movement of said thread engaging portion in engagement with said bobbin thread.

2. In a sewing machine as set forth in claim 1 in which means are provided for establishing a thread path from said thread carrying bobbin to said needle penetration in a work piece which thread path varies in length in direct proportion to the laterally jogged position of said needle, and in which said arrangement for pulling thread from said thread carrying bobbin pulls an amount of thread from said thread carrying bobbin between each successive stitch which varies in direct proportion to the laterally jogged position of the preceding needle penetration, in which the variations in thread path length and amount of bobbin thread pull-off are inversely related to each other, and in which the difference in the amount of bobbin thread pulled from said thread carrying bobbin after needle penetrations at opposite extreme laterally jogged positions is substantially equal to the difference in the length of said bobbin thread paths between needle penetrations at said opposite extreme laterally jogged positions.

3. A variable bobbin thread pull-off for a zig zag sewing machine having a work feeding mechanism for establishing a direction of feed of a work piece being stitched, a thread carrying needle capable of jogging movement within a predetermined range laterally of said direction of feed, said needle having an endwise reciprocating motion imparted thereto so that said needle will penetrate a work piece and define a line of zig zag stitch formation in cooperation with said work feeding mechanism, a loop taker adapted to operate in cooperation with said needle in the formation of lock stitches and having a bobbin accommodating cavity, a thread carrying bobbin disposed in said cavity, and thread guiding means associated with said loop taker and arranged beyond one side of line of zig zag stitch formation for establishing the path of said bobbin thread to said needle penetration, said variable bobbin thread pull-off comprising:

a. an elongate bar member formed with a portion extending substantially parallel to the direction of said jogging movement of said needle and positioned between said path of needle jogging movement and said bobbin;

b. pivotal mounting means on the sewing machine to hold the elongated bar member, said pivotal mounting means being arranged on an axis substantially perpendicular to the direction of said needle jogging movement and beyond the opposite side of zig zag stitch formation from said bobbin thread guide means; and c. means for effecting angular movement of said elongated bar member about said axis to pull a predictable length of thread from the bobbin said predictable length having a predetermined relationship to the position of said needle penetration within said range of jogging movement.

4. A veriable bobbin thread pull-off as set forth in claim 3 for a sewing machine in which the work feeding mechanism includes a work feed dog having rising and falling as well as work advancing feed movements; in which said elongated bar member extends over said bobbin thread path and beneath said work feed dog; and in which said means for effecting angular movement of the elongated bar member comprises resilient means biasing the elongated bar member upwardly into engagement with said work feed dog so as to partake of the rising and falling movement thereof.

5. In a sewing machine having a bed and stitch forming instrumentalities including a thread carrying needle, said needle having an endwise reciprocating motion imparted thereto so that said needle will penetrate a work piece supported by said bed, a feed dog for effecting movement of the work piece to produce a line of stitch formation in cooperation with said needle, said needle being capable of having a jogging motion imparted thereto which is lateral to the direction of said movement of the work piece to produce a zig zag line of stitch formation, a looptaker carried in said bed and adapted to operate in cooperation with said needle in the formation of lockstitches and having a bobbin accommodating cavity, a thread carrying bobbin disposed in said cavity, and means associated with said loop taker for guiding the thread issuing from said bobbin, said bobbin thread guiding means being arranged beyond one side of the line of zig zag stitch formation produced by any laterally jogged positions of said needle, and means for pulling thread from said thread carrying bobbin between each successive stitch comprising:

a. a movable bobbin thread pull-off member having a thread engaging surface transverse to said thread path, b. means pivotally supporting said bobbin thread pull-off member on an axis arranged substantially parallel to and beyond the opposite side of said line of zig zag stitch formation from said bobbin thread guiding means, and c. means for effecting angular movement of said bobbin thread pull-off member about said pivotal axis in a fixed path cyclically and in time relation with said stitch forming instrumentalities whereby a predictably different amount of bobbin thread is pulled off for each different laterally jogged position of said needle penetration.

* * * * *